US006059008A

United States Patent [19]

Yoshida et al.

[11] Patent Number: 6,059,008

[45] Date of Patent: May 9, 2000

[54] BRAKING DEVICE FOR SHUTTER FOR BUILDING

[75] Inventors: Mitsuo Yoshida, Dallas, Tex.; Takanobu Kuribayashi, Tokyo, Japan

[73] Assignee: Overhead Door Corporation, Dallas, Tex.

[21] Appl. No.: 08/937,483

[22] Filed: Sep. 25, 1997

[51] Int. Cl.[7] ..... E05F 15/20

[52] U.S. Cl. ..... 160/296; 160/8

[58] Field of Search ..... 160/296, 298, 160/8, 310, 1, 9, 7; 192/58.41

[56] References Cited

U.S. PATENT DOCUMENTS

| | | | |
|---|---|---|---|
| 4,112,996 | 9/1978 | Fohl | 160/296 |
| 4,838,333 | 6/1989 | Mottura | 160/296 |
| 5,443,109 | 8/1995 | Benthin | 160/298 |
| 5,447,477 | 9/1995 | Bresson et al. | 160/310 |
| 5,488,983 | 2/1996 | Jung | 160/298 |
| 5,634,507 | 6/1997 | Kwoka | 106/296 |
| 5,711,360 | 1/1998 | Voitte | 160/310 |
| 5,799,716 | 1/1998 | Yamaguchi et al. | 160/310 |
| 5,881,849 | 3/1999 | Gassmann | 192/58.41 |

*Primary Examiner*—Blair M. Johnson

*Attorney, Agent, or Firm*—Akin, Gump, Strauss, Hauer & Feld, L.L.P.

[57] ABSTRACT

A device for preventing a shutter curtain from falling by its own weight and allowing the shutter curtain to descend in a braked manner, is provided such that separate space for the device does not need to be provided.

A viscous clutch 9, which provides braking to the rotation of a winding shaft rotating in the direction of closing during the shutter curtain 2 descending by its own weight, is provided between the winding shaft 7 and a bracket 5 of the building. Further, the viscous clutch is arranged to be smaller in diameter than the innermost inner diameter of the shutter curtain wound onto the winding wheel 4, thus fitting within the wound shutter.

10 Claims, 5 Drawing Sheets

BRAKING DEVICE FOR SHUTTER FOR BUILDING

BACKGROUND OF THE INVENTION

1. Field of the Invention

The present invention relates to the art of shutters for buildings or homes, such being mounted to openings in buildings.

2. Description of the Related Art

Generally, there are types of such shutters for buildings wherein the shutter curtain is arranged to descend by its own weight in the event that a brake is released, such as is with the case of weight shutters. With these type of shutters, the shutter curtain is opened and closed by means of driving operation by opening/closing gear. In such cases, the opening/closing gear is comprised of an electric motor, brake, and governor (speed-adjusting device). The arrangement is such that in the event that the brake is released in conjunction with detection of an abnormality such as fire, the speed of the shutter curtain is adjusted by a governor so that the shutter curtain is automatically closed while preventing the shutter curtain from falling by its own weight, thereby securing a fire prevention section.

However, such shutters for buildings are arranged such that a driving force transmitting mechanism such as a chain or the like transmits the diving force from the output shaft of the opening/closing gear to a winding drum, and in the event that this driving force mechanism is broken, the falling prevention function of the aforementioned governor does not work at all, and the shutter falls under its own weight.

In order to deal with this problem, arrangements have been proposed wherein means for preventing falling of the shutter curtain in the event that the drive chain is broken and so forth are provided, such as disclosed in Japanese Unexamined Patent Publication No. 61-146391 and Japanese Unexamined Patent Publication No. 62-180196.

However, such known arrangement require a dedicated falling prevention device, resulting in an increased number of parts and a complicated structure, and further, space must be separately provided for the falling prevention device, increasing the size of the overall shutter apparatus.

Moreover, the shutter curtain which has been caught by the falling prevention device functioning is suspended in an emergency half-opened state, with no further means to close the shutter. Further yet, since this state is an abnormal state, maintenance by a specialist is required, and until the specialist arrives on the site, a guardsman or the like must be posted to prevent people from entering or exiting through the half-opened shutter, and moreover yet, leaving the shutter in this half-opened state at nighttime poses further security problems. The present invention has been made in order to deal with the aforementioned problems in the known art.

SUMMARY OF THE INVENTION

Accordingly, it is an object of the present invention to provide a braking device for a shutter for buildings wherein the above problems are solved, the braking device for a shutter for buildings according to the present invention comprising: a shutter curtain which descends due to own weight; winding drum for winding the aforementioned shutter curtain; a building; and braking means provided between the aforementioned winding drum and the aforementioned building, the aforementioned braking mechanism providing the aforementioned shutter curtain with a braking force operating upon rotation of the aforementioned winding drum in the direction of the aforementioned shutter curtain closing; wherein the aforementioned braking means is formed to be of a smaller diameter than the inner diameter of the shutter curtain wound onto the winding drum when measured at the innermost portion thereof, thus allowing the aforementioned braking means to be stored within the aforementioned wound shutter curtain. Thus, in the event that the brake is released or the drive force transmitting mechanism is broken, the shutter curtain descends but its own weight in a braked state and closes off the opening. Thus, a dedicated falling prevention device is not needed, resulting in a reduced number of parts and a simplified structure, and moreover, the shutter curtain does not stay in a half-opened state as with the known art, improving security as well. In addition, there is no need to provide extra space for the braking means to be disposed, also facilitating miniaturization of the overall apparatus.

The braking device for a shutter for buildings according to the present invention can be carried out by the winding drum being rotated by driving of opening/closing gear.

Further, the braking device for a shutter for buildings according to the present invention can be carried out by arrangements wherein the aforementioned winding drum comprises: a winding wheel for winding the aforementioned shutter curtain; and a winding shaft which is formed integrally with the aforementioned winding wheel and is rotatably supported by the aforementioned building; or wherein the aforementioned winding drum comprises: a fixed shaft fixed to the aforementioned building; and a winding wheel supported rotatably by the aforementioned fixed shaft; the aforementioned braking means being provided between the aforementioned building and the aforementioned winding shaft or the aforementioned winding wheel in the case of the former arrangement, and the aforementioned braking means being provided between the aforementioned fixed shaft or the aforementioned building to which the aforementioned fixed shaft is fixed and the aforementioned winding wheel in the case of the latter arrangement.

Moreover, the braking device for a shutter for buildings according to the present invention can be carried out by the braking means comprising a viscous clutch which provides braking force owing to viscous resistance received by an internally sealed viscous substance.

Moreover yet, the braking means may be provided with a single-directional clutch in order to prevent the aforementioned braking means from receiving braking force in the direction of rotation toward the opening direction of the aforementioned shutter curtain, which is advantageous in that the braking means will not provide extra drag when opening the shutter curtain.

DESCRIPTION OF THE PREFERRED EMBODIMENTS

Figure 1:
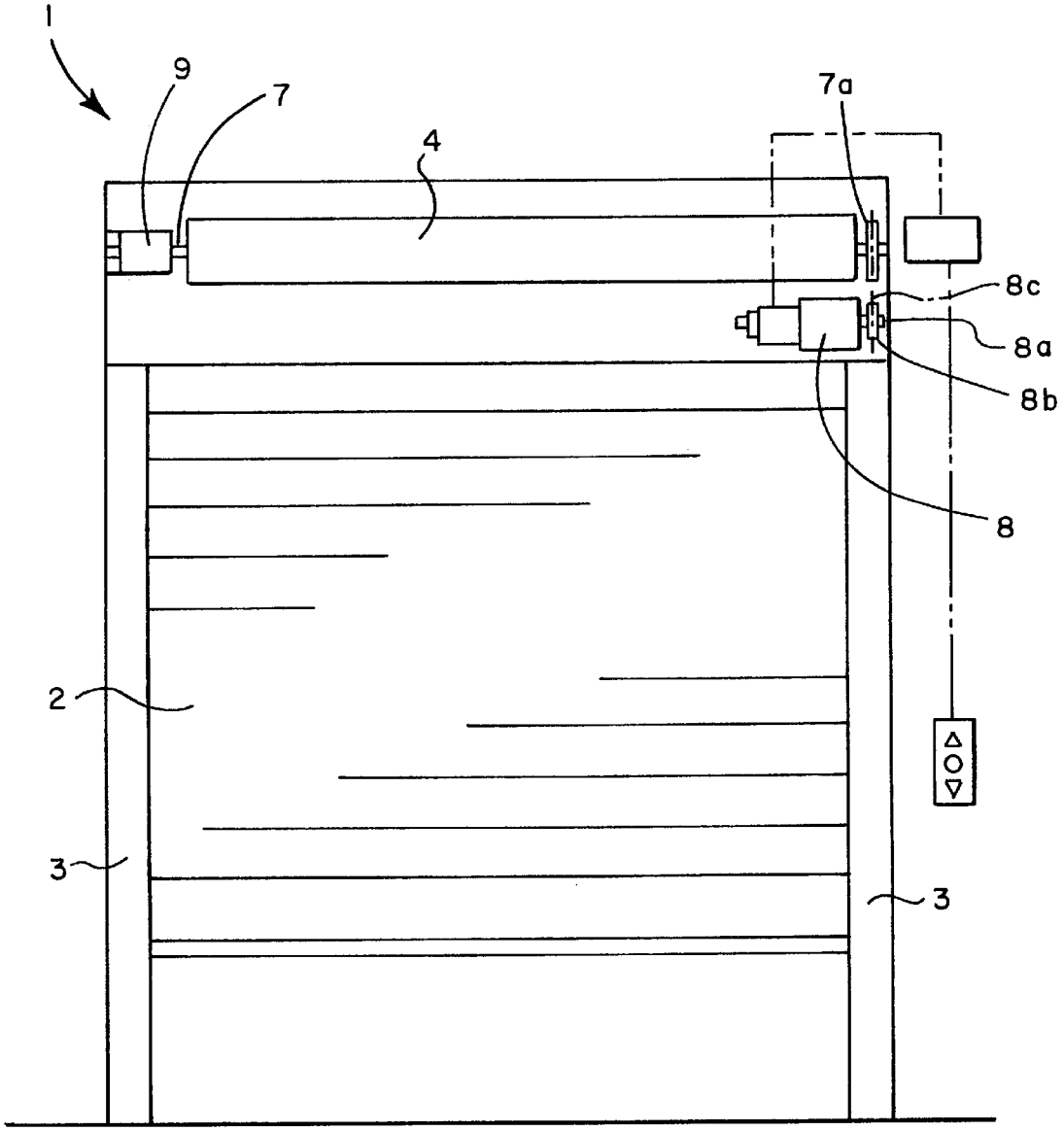
FIG. 1 is a front view of an electric shutter.
Figure 2:
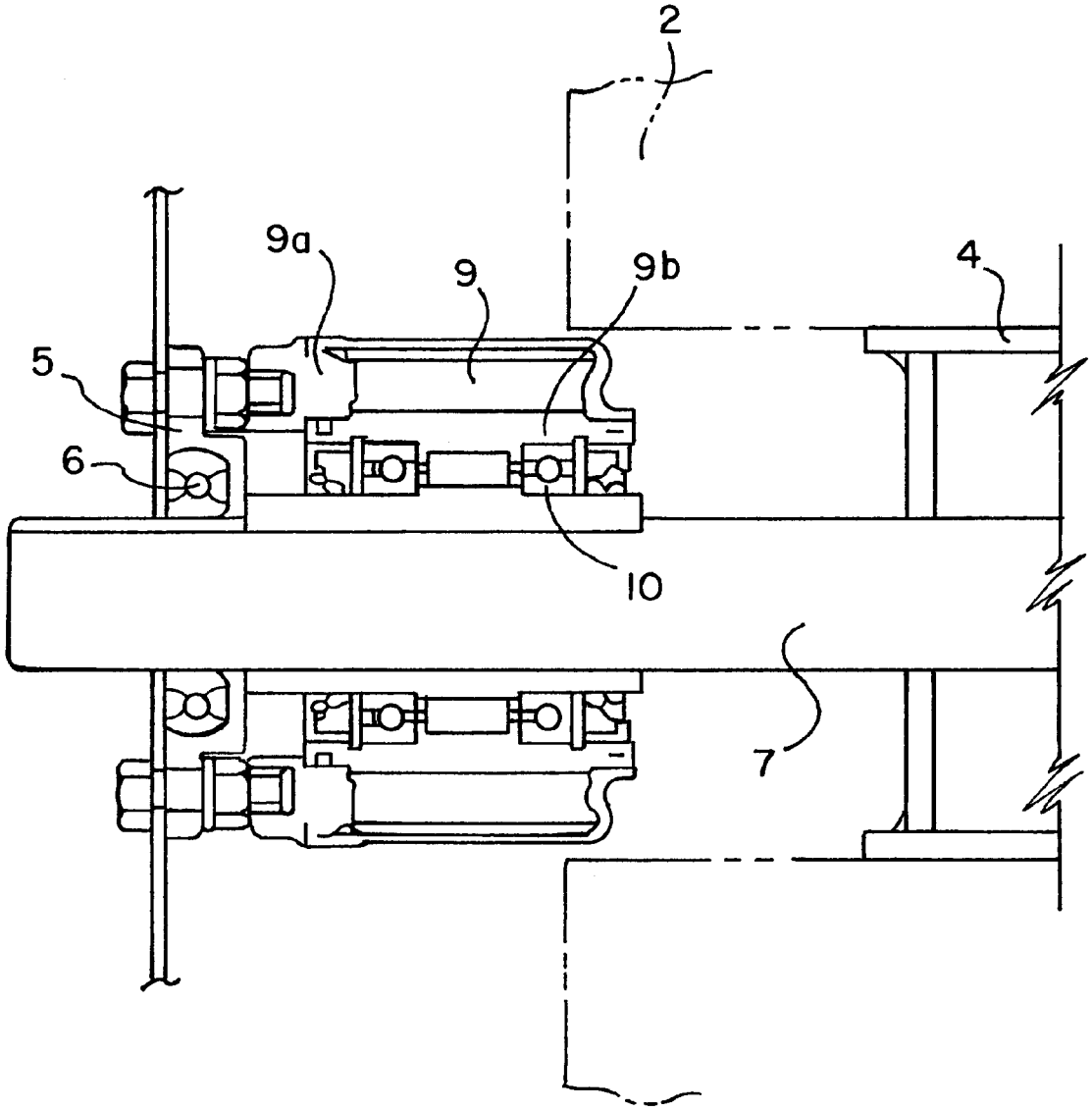
FIG. 2 is an enlarged drawing of the principal components.
Figure 3:
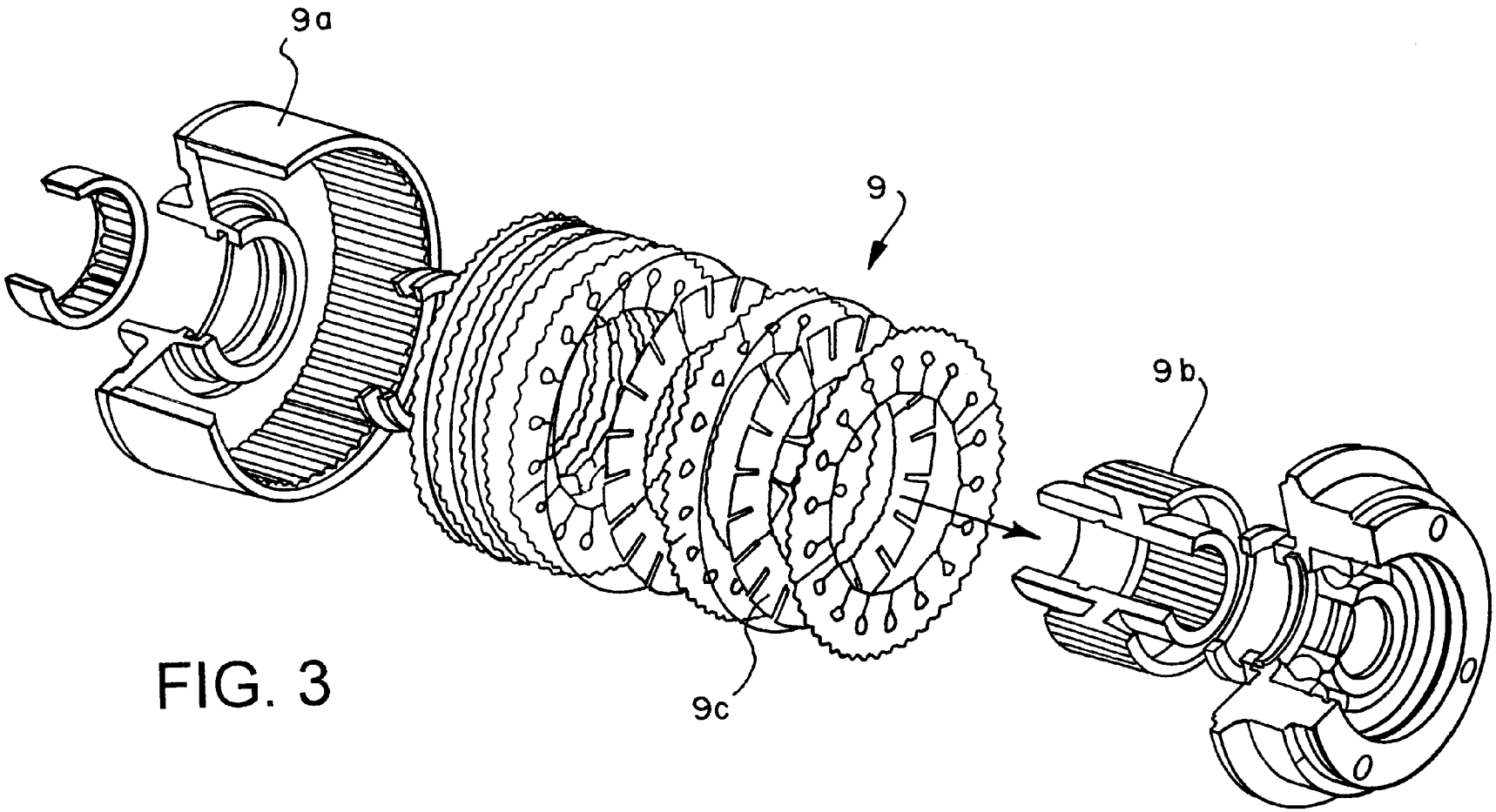
FIG. 3 is a disassembled perspective view of a viscous clutch.

An embodiment of the present invention will now be described with reference to the Figures. In the Figures, reference numeral 1 denotes an electric shutter mounted to an opening in buildings designed to descend by its own weight. This electric shutter 1 is the same as conventional art in respect to basic construction, such as being comprised of a shutter curtain 2 which opens and closes the opening by being guided up and down along guide rails 3 which are erected on either side thereof.

Reference numeral 4 denotes a winding wheel upon which the shutter curtain 2 is wound, with the winding wheel 4 being integrally provided with a winding shaft 7 rotatably supported via bearings 6 to a bracket 5 fixed to a building at the upper end of the opening.

Also, reference numeral 8 denotes an opening/closing gear comprised of an electric motor and brake (neither shown), with an output shaft 8*a* of the aforementioned opening/closing gear 8 and a coupled sprocket 7*a* provided to the aforementioned winding shaft 7 being synchronously linked via an endless drive chain 8*c*. The shutter curtain 2 can thus be opened or closed by rotation of the winding shaft 7 due to forward or reverse rotation of the opening/closing gear 8. Also, the brake is set such that the brake is released automatically in conjunction with detection of an unshown fire detection device or the like. Thus, the shutter curtain 2 closes off the opening by means of descending by its own weight, with the braking means which provide braking force in order to prevent the shutter curtain 2 from failing by its own weight being constructed using a viscous clutch (viscous coupling) 9. Incidentally, it goes without saying that the opening/closing gear is by no means restricted to an electrical system, manual arrangements using a handle or chain are conceivable for the opening/closing gear, and the present invention may be carried out with such arrangements, as well.

The aforementioned viscous clutch 9 is comprised of housing 9*a*, a hub 9*b*, a plurality of rotating plates 9*c*, etc., with the aforementioned plurality of rotating plates 9*c* being arranged so that there are plates which rotate integrally with the housing 9*a* and plates which rotate integrally with the hub 9*b*, these plates being alternately arrayed, with high-viscosity silicone oil filling the space between these plates. Further, the housing 9*a* is integrally attached to the bracket 5 of the aforementioned building, and the hub 9*b* is attached to the aforementioned winding shaft 7 via the single-directional clutch 10 so as to be free from rotation of the aforementioned shaft 7 during raising of the rotation, but so as to rotated integrally therewith during descending of the curtain.

In the event that the winding shaft 7 rotates due to the shutter curtain descending by its own weight due to the aforementioned brake being released or the drive chain 8*c* breaking, the hub 9*b* rotates integrally with the aforementioned winding shaft 7 so that the rotating plates 9*c* on the side of the hub 9*b* rotate relatively to the rotating plates 9*c* on the side of the housing 9*a*, causing shearing of the silicone oil which results in generation of viscous torque between the plates 9*c*, thereby providing braking force to the rotation of the winding shaft during the curtain descending. According to this construction, the shutter curtain 2 which is braked by the viscous clutch 9 descends and closes the opening.

Now, in the event that the silicone oil of the viscous clutch 9 is continuously subjected to a great shearing force, there are rare instances wherein the pressure within the oil increases suddenly and results in the hump phenomena in which the rotation of the winding shaft 7 locks, but the design is such that the shearing force in the silicone oil is not very great when the shutter curtain 2 is caused to descend by its own weight which braking is provided to the rotation of the aforementioned winding shaft 7, and hence, the hump phenomena hardly ever occurs.

Further, the outer diameter of the aforementioned viscous clutch 9 is smaller in diameter than the inner diameter of the first roll of the shutter curtain 2 wound onto the winding wheel 4, so that the viscous clutch 9 fits within the inner space within the wound shutter curtain 2 without interfering therewith.

With the above-described construction, in the event that the shutter curtain 2 attempts to free-fall due to the brake being released in conjunction with detection by a fire detection device or the like or the drive chain 8*c* breaking, the viscous clutch 9 provided between the bracket 5 on the casing and the winding shaft 7 operates so as to provide braking force to the rotation of the winding shaft 7 in the direction of the curtain descending, as described above, and hence the shutter curtain 2 descends slowly in a braked state, and closes the opening.

Consequently, there is no need to provide a falling prevention device in preparation for the drive chain 8*c* breaking, as with known apparatuses which provide a governor on the side of the opening/closing gear 8 to adjust the speed of the shutter curtain 2 descending by its own weight in the event that the brake is released. Rather, the viscous clutch 9 which provides braking force to the rotation of the winding shaft 7 in the direction of the curtain descending suffices to deal with the brake being released, as a matter of course, and further with the drive chain 8*c* breaking, so that functions can be shared by the single device, thereby reducing the number of parts and simplifying the structure.

Further, there is no half-opened state such as with the aforementioned known falling-prevention devices wherein the shutter curtain 2 is subjected to emergency stopping due to the falling-prevention device operating which results in a condition wherein the shutter remains half-open until a specialist arrives, until which time the manager must restrict individuals attempting to pass through. Thus, this arrangement is advantageous from a security perspective, as well.

Moreover, the aforementioned viscous clutch 9 is advantageous in that it is smaller in outer diameter than the inner diameter of the first roll of the shutter curtain 2 wound onto the winding wheel 4, so that the viscous clutch 9 fits within the inner space within the wound shutter curtain 2, so that the viscous clutch is efficiently stored and separate space does not need to be provided therefor.

Moreover yet, the viscous clutch 9 is attached to the aforementioned winding shaft 7 via the single-direction rotational clutch 10 so as to not brake the rotation of the aforementioned winding shaft 7 during raising of the curtain, and this arrangement is advantageous in that there is no concern that the viscous clutch 9 may operate during winding of the shutter curtain 2 placing a load on the electric motor.

On the other hand, viscous resistance operates during lowering the shutter curtain 2, but regarding types which descend by their own weight, the motor driving force works to damp the shutter curtain 2 descending by its own weight during closing operations, so this arrangement is advantageous when the viscous resistance operates during closing operations, as the viscous resistance operates in a direction which reduces the load on the motor.

Now, it is needless to say that the present invention is by no means restricted to the first embodiment thereof described above. Regarding the braking means, any arrangement may be employed which provides braking to the rotation of the winding drum during the shutter curtain falling by its own weight and reduces the rotation thereof, and is by no means restricted to a viscous clutch. Instead, an appropriate braking device including a governor may be employed. With such arrangements wherein the winding shaft and winding wheel are rotatably provided to the building, as with the first embodiment, the braking means may be provided between the building such as a bracket of the building, etc., and the winding wheel.

Figure 4:
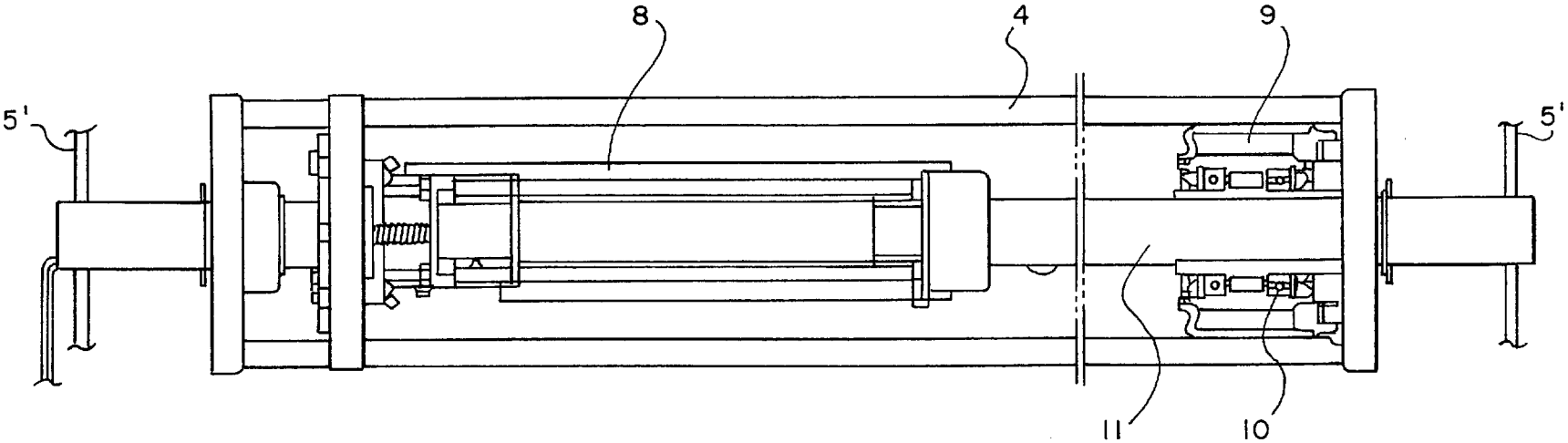
FIG. 4 is an enlarged drawing of the principal components of a second embodiment.
Figure 5:
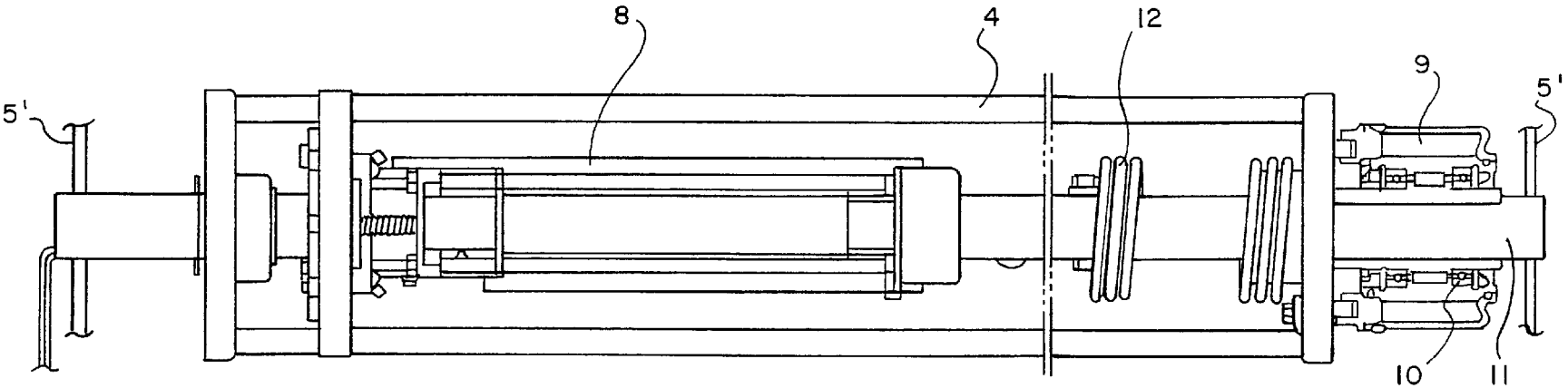
FIG. 5 is an enlarged drawing of the principal components of a third embodiment.

Also, the present invention may be carried out in an arrangement such as a second embodiment shown in FIG. 4 wherein the winding wheel 4 onto which the shutter curtain 2 is wound is rotatably supported by a fixed shaft 11 fixed to the building. In this case, the viscous clutch 9 can be efficiently stored by means of being provided between the winding wheel 4 and the fixed shaft 11 and within the winding wheel 4. On the other hand, regarding an arrangement such as a third embodiment shown in FIG. 5 wherein a spring 12 is provided within the aforementioned winding wheel 4 in order to provide force in the direction of raising the curtain, the viscous clutch 9 can be provided to the right or left side of the winding wheel 4, and with this case as well, the viscous clutch 9 should be smaller in outer diameter than the inner diameter of the first roll of the shutter curtain 2 wound onto the winding wheel 4, so that the viscous clutch 9 fits within the inner space within the wound shutter curtain 2.

Incidentally, although the second and third embodiments are arrangements wherein the opening/closing gear 8 is stored within the winding wheel 4 and the opening/closing gear 8 and winding wheel 4 are driven via gears, so that a drive chain is not provided. However, there can be various causes of the shutter curtain 2 to fall by its own weight even with such arrangements which do not use a chain besides releasing of the brake, such as the drive transmission mechanism, e.g., gears failing, or in the instance of arrangements which use a spring 12 such as the third embodiment, the spring 12 being severed, etc. The present invention provides the same effects with these arrangements as with the first embodiment, in such emergencies.

Further, the present invention may be carried out similarly in arrangements wherein the winding wheel is rotatably borne by a fixed shaft fixed to the building, by means of attaching the breaking means between the casing such as the bracket, etc., and the winding wheel.

What is claimed:

1. In a rollup shutter comprising a shutter curtain which descends due to its own weight, a winding drum for winding said shutter curtain including a rotatable winding wheel for winding said shutter curtain thereon, said winding wheel being supported on a shaft, said shaft being supported by at least one support member;

a braking mechanism for retarding but not arresting rotation of said winding wheel to allow descent of said shutter curtain due to its own weight by unwinding of said shutter curtain from said winding wheel, said braking mechanism including a viscous clutch comprising a generally cylindrical housing of a diameter at least slightly less than the diameter of said winding wheel on which said shutter curtain is wound so as to allow said braking mechanism to be stored at least partially within a wound shutter curtain when said shutter curtain is wound on said winding wheel, said viscous clutch further comprising a hub and a plurality of clutch plates arranged such that a first predetermined number of clutch plates are connected to said housing and are nonrotatable with respect to said housing and are interleaved between a second predetermined number of clutch plates which are connected to said hub for rotation therewith relative to said first predetermined number of clutch plates, said hub is supported on said shaft by way of a directional clutch to provide for free rotation of said winding wheel with respect to said one support member in a direction of rotation to wind said shutter curtain on said winding wheel, and said viscous clutch includes a high viscosity oil disposed in spaces between said plates, respectively, for retarding rotation of said winding wheel to allow descent of said shutter curtain due to its own weight.

2. The invention set forth in claim 1 wherein:

said housing is connected to and is not rotatable with respect to said one support member and said housing is disposed between said one support member and said winding wheel, and said hub is non-rotatable with respect to said shaft in a direction of rotation which corresponds to the direction of rotation of said winding wheel to unwind said shutter curtain therefrom.

3. The invention set forth in claim 1 wherein:

said housing is connected directly to said one support member and said shaft is mounted in bearing means connected to said one support member for rotation with said winding wheel.

4. The invention set forth in claim 1 wherein:

said shaft is fixed to opposed spaced apart support members for non-rotation with respect to said support members, said winding wheel is mounted for rotation on and relative to said shaft and said housing is connected to said winding wheel for rotation therewith.

5. The invention set forth in claim 4 including:

a drive motor supported on said shaft and drivably connected to said winding wheel.

6. The invention set forth in claim 5 wherein:

said drive motor and said housing are mounted within said winding wheel.

7. The invention set forth in claim 4 wherein:

said viscous clutch is mounted adjacent one end of said winding wheel and said housing is connected to said winding wheel for rotation therewith.

8. The invention set forth in claim 7 including:

a spring operably connected to said shaft and to said winding wheel and disposed within said winding wheel for exerting a counterbalance force on said winding wheel.

9. The invention set forth in claim 8 including:

a drive motor mounted on said shaft and drivingly connected to said winding wheel.

10. The invention set forth in claim 9 wherein:

said drive motor is mounted within said winding wheel.

* * * * *